US007303088B2

(12) United States Patent
Sawyer et al.

(10) Patent No.: US 7,303,088 B2
(45) Date of Patent: Dec. 4, 2007

(54) TAMPER-EVIDENT CLOSURE

(75) Inventors: Duane Sawyer, York, PA (US); Ryan Davidson, Evansville, IN (US); Robert C. Weilminster, Ellicott City, MD (US); Frederick R. Middlestadt, White Marsh, MD (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 11/276,724

(22) Filed: Mar. 10, 2006

(65) Prior Publication Data

US 2006/0249474 A1 Nov. 9, 2006

Related U.S. Application Data

(60) Provisional application No. 60/661,097, filed on Mar. 11, 2005.

(51) Int. Cl.

| | |
|---|---|
| ***B65D 39/00*** | (2006.01) |
| ***B65D 41/00*** | (2006.01) |
| ***B65D 51/04*** | (2006.01) |
| ***B67D 5/00*** | (2006.01) |

(52) U.S. Cl. ..... 215/237; 215/256; 215/255; 220/254.5; 222/556; 222/153.07

(58) Field of Classification Search ..... 215/237, 215/254, 256; 222/153.01, 153.14, 546, 222/153.07, 556, 254.5, 255, 270, 266, 276, 222/153.06, 566

See application file for complete search history.

(56) References Cited

U.S. PATENT DOCUMENTS

| | | | | |
|---|---|---|---|---|
| 1,326,885 | A | 12/1919 | Wales | |
| 3,850,329 | A | 11/1974 | Robinson | |
| 4,738,375 | A | 4/1988 | Rosen et al. | |
| 5,320,235 | A * | 6/1994 | Joyce | 215/254 |
| 5,386,918 | A | 2/1995 | Neveras et al. | |
| 5,617,968 | A | 4/1997 | Luburic | |
| 5,642,825 | A | 7/1997 | Wohlgemuth | |
| 5,775,528 | A | 7/1998 | Wohlgemuth et al. | |
| 6,070,765 | A | 6/2000 | Holzboog | |
| 6,324,334 | B1 * | 11/2001 | Morioka et al. | 386/52 |
| 6,419,101 | B1 | 7/2002 | Hessel et al. | |
| 6,520,370 | B2 * | 2/2003 | Nyman et al. | 220/832 |
| 6,631,820 | B2 * | 10/2003 | Harrold et al. | 215/237 |
| 6,644,487 | B2 * | 11/2003 | Smith et al. | 215/235 |
| 6,644,491 | B2 | 11/2003 | Dewig et al. | |

* cited by examiner

*Primary Examiner*—Robin A. Hylton

(74) *Attorney, Agent, or Firm*—Barnes & Thornburg LLP

(57) ABSTRACT

A tamper-evident closure includes a body adapted to mount on a container, a cap, and a hinge coupled to the body and to the cap. A tamper-evident tear strip is coupled to the cap to retain the cap temporarily in a fixed position relative to the body.

26 Claims, 9 Drawing Sheets

FIG 5A
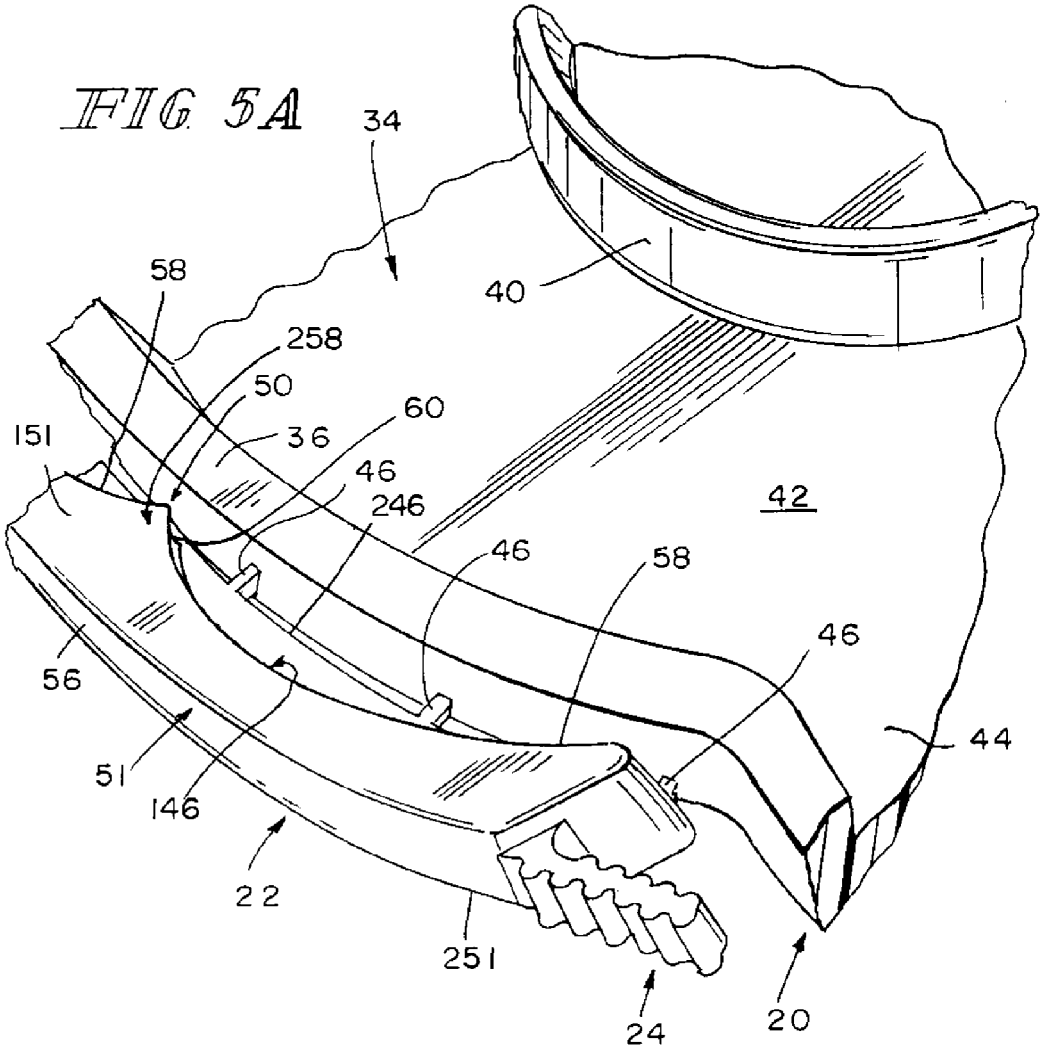
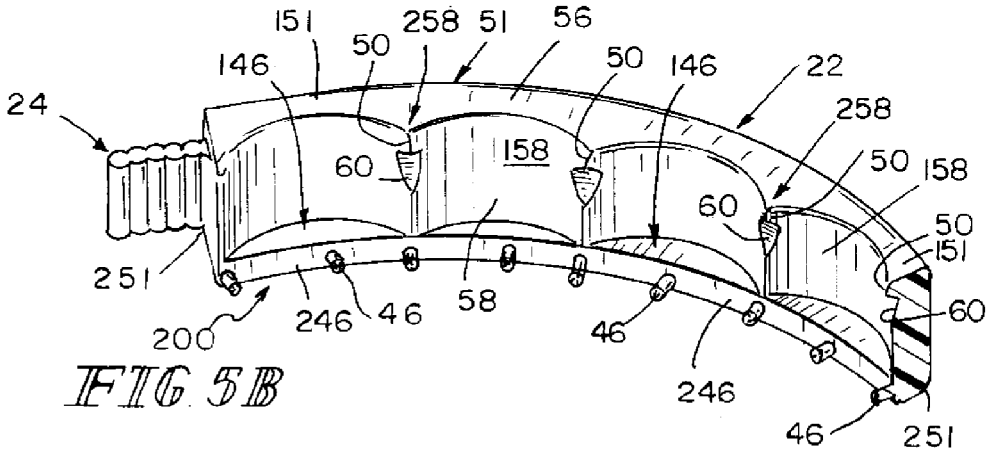
FIG 5B

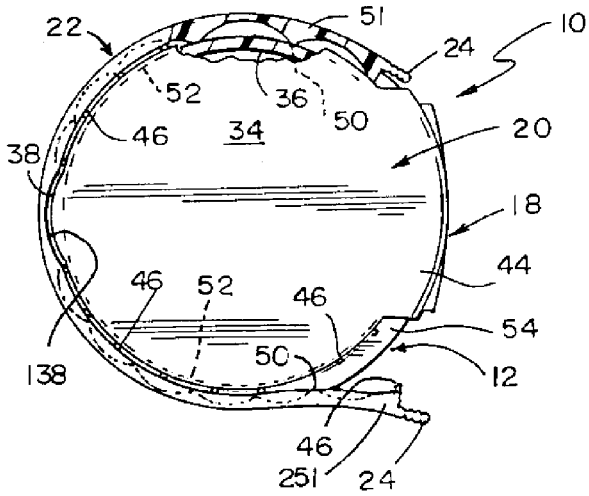
FIG. 6
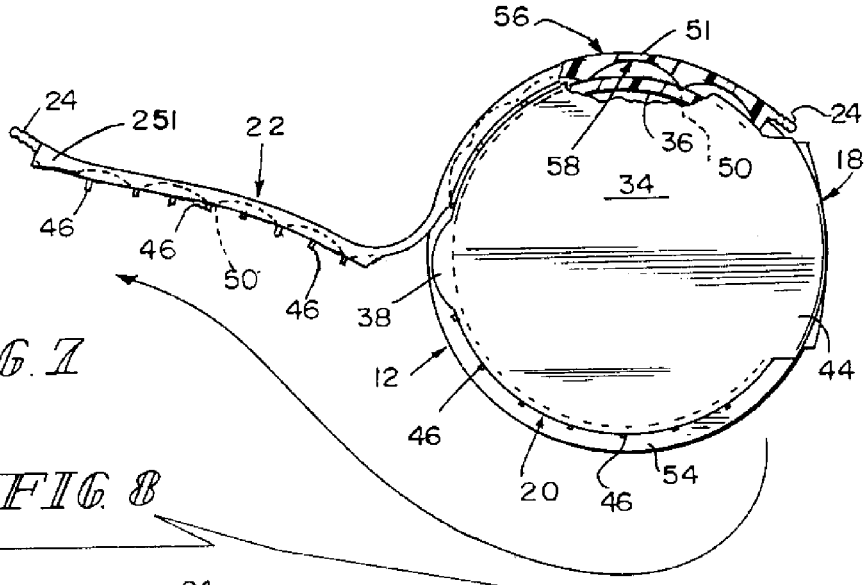
FIG. 7
FIG. 8
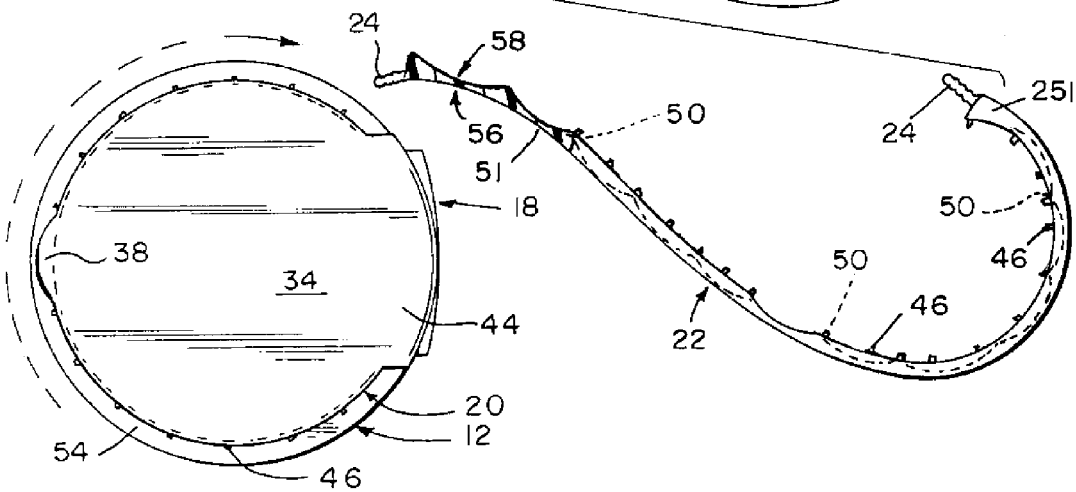

TAMPER-EVIDENT CLOSURE

This application claims priority under 35 U.S.C. § 119(e) to U.S. Provisional Application Ser. No. 60/661,097, filed Mar. 11, 2005, which is expressly incorporated by reference herein.

BACKGROUND

The present disclosure relates to closures for mounting on the top of bottles or other containers, and in particular to a container closure including a "flip-top" cap. More particularly, the present disclosure relates to a tamper-evident closure having a tear strip that must be removed before the closure can be manipulated to dispense product stored in the bottle.

Closures are provided to cover product-dispensing openings formed in bottles or other containers, It is known to provide a "tamper-evident" tear strip that is coupled to a portion of the closure. If the tear strip is missing when a consumer purchases a bottle or other container, then the consumer is put on notice that someone may have tampered with the bottle and gained unauthorized access to product stored in the bottle through the opening covered normally by the closure. After the tear strip is removed, a remaining portion of the closure is used to retain the closure in place on the bottle.

SUMMARY

According to the present disclosure, a tamper-evident closure includes a body formed to include a product-dispensing spout and adapted to mount on a filler neck of a bottle or other container. The tamper-evident closure also includes a flip-top cap appended to a hinge arranged to support the flip-top cap for movement from a closed position on the body covering the product-dispensing spout to an opened position away from the body uncovering the product-dispensing spout.

In illustrative embodiments, a tear strip is coupled to the body and to the flip-top cap to retain the flip-top cap in the closed position as a security measure until a consumer elects for the first time to move the flip-top cap relative to the body to assume the opened position. In illustrative embodiments, a series of frangible connectors are provided to link the tear strip temporarily to the flip-top cap. Also, a series of retention fingers are provided on the tear strip and arranged to extend into a finger-receiving channel provided in the body to limit movement of the flip-top cap relative to the body. The retention fingers on the tear strip remain in the finger-receiving channel formed in the body to retain the flip-top cap in the closed position on the body as long as the tear strip is coupled to the flip-top cap by the frangible connectors.

In illustrative embodiments, a cap retainer is provided on the underside of the flip-top cap. The cap retainer is configured to provide "spout grip" means for gripping the product-dispensing spout formed in the body when the flip-top cap is moved to assume the closed position to retain the flip-top cap in the closed position on the body. Once the tear strip is separated from the flip-top cap, for example, by breaking the frangible connectors, the retention fingers provided on the tear strip are removed from the finger-receiving channel formed in the body. Thereafter, the flip-top cap is retained on the body in the closed position only by engagement of the remaining cap retainer on the underside of flip-top cap with, for example, the product-dispensing spout formed in the body.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 5A is an enlarged perspective view of the underside of the flip-top cap (prior to mounting the tamper-evident closure on a bottle neck as shown in the sequence illustrated in FIGS. 15-19) showing the tear strip in an "inverted" position (as compared to FIGS. 1-4), showing three spaced-apart frangible connectors interconnecting the flip-top cap and the tear strip, and showing one of the thumb-pull tabs on the tear strip;

FIG. 5B is a perspective view of a portion of the "inverted" tear strip shown in FIG. 5A showing nine "broken" frangible connectors appended to a curved inner edge along a "top" portion of the tear strip and showing five retention fingers formed in a "bottom" portion of the tear strip so that each retention finger is located at a "wave-crest" portion of a scalloped inner wall of the tear strip;

FIGS. 6-8 illustrate one technique for separating the tear strip from the body and the flip-top cap;

FIG. 6 is a top plan view of the tamper-evident closure of FIG. 1, with portions broken away, showing an initial stage of separation of the tear strip from other portions of the tamper-evident closure and showing breakage of three frangible connectors and removal of one of the radially inwardly extending retention fingers on the tear strip from the annular finger-receiving channel formed in the body;

FIG. 7 is a top plan view similar to FIG. 6 showing partial separation of the tear strip;

FIG. 8 is a top plan view similar to FIGS. 7 and 8 showing complete separation of the tear strip;

DETAILED DESCRIPTION

Figure 1:
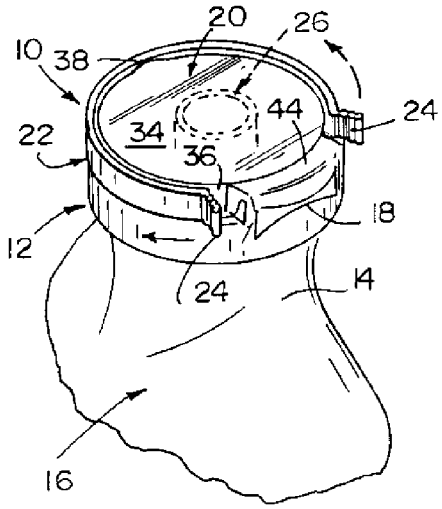
FIG. 1 is a perspective view of a tamper-evident closure mounted on a bottle to cover a mouth opening into an interior region formed in the bottle showing a tear strip provided with thumb-pull tabs at opposite ends of the tear strip and formed to provide a tamper-evident security feature on the closure and showing that the tear strip extends partly around an annular perimeter exterior side wall of a flip-top cap coupled to an underlying body formed to include a product-dispensing spout (shown in phantom) by a hinge.
Figure 2:
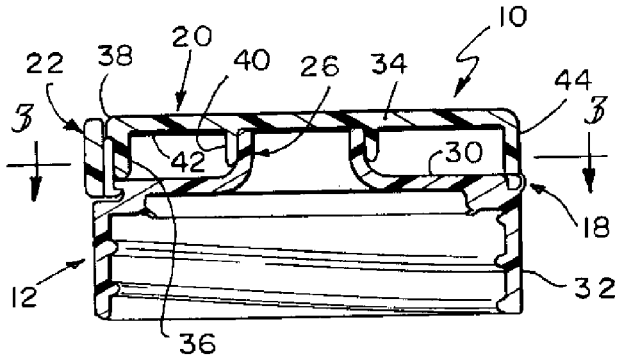
FIG. 2 is a sectional view of the tamper-evident closure of FIG. 1 separated from the bottle showing the body formed with internal screw threads to mate with a threaded neck on the bottle of FIG. 1 and formed to include the product-dispensing spout, the flip-top cap coupled to a peripheral portion of the body by a "living" hinge (on the right side of the closure) and mated with the body to close the product-dispensing spout, and a portion of the tear strip (on the left side of the closure coupled to the body and to the flip-top cap)

A container closure 10 includes a body 12 adapted to mount on a neck 14 of a container 16, a hinge 18, a flip-top cap 20, and a tamper-evident tear strip 22 as shown, for example, in FIGS. 1 and 2. When mounted as shown in FIG. 1, closure 10 closes an open mouth (not shown) formed in neck 14 to provide an opening into an interior region of container 16. Tear strip 22 can be separated from body 12 and flip-top cap 20 easily using a thumb-pull tab 24 in a manner shown, for example, in FIGS. 6-8. Once tear strip 22 has been separated, flip-top cap 20 can be moved on hinge 18 between an opened position exposing a product-dispensing spout 26 formed in body 12 as shown, for example, in FIGS. 10 and 11 and a closed position covering product-dispensing spout 26 as shown, for example, in FIG. 12.

Figure 13A:
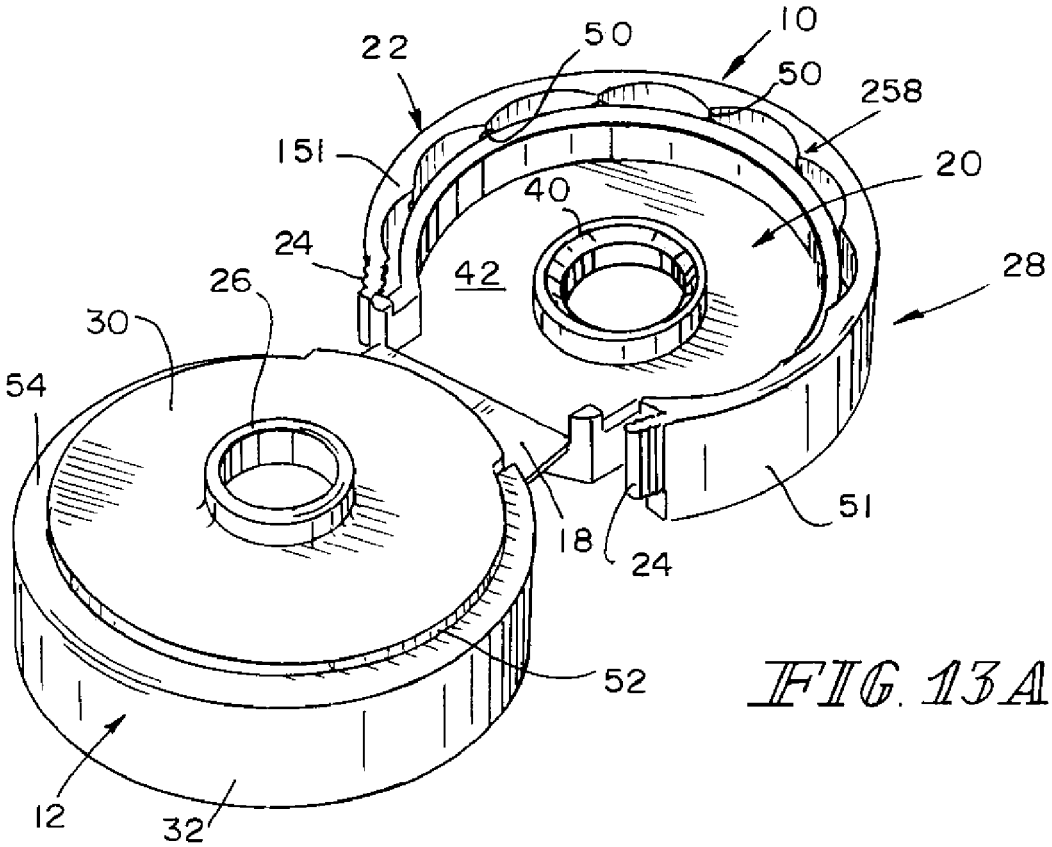
FIGS. 13A and 13B show perspective views of the opened tamper-evident closure of FIG. 1 as it would appear at a factory before movement of the flip-top cap to its closed position on the body, which movement causes the radially inwardly extending retention fingers on the tear strip to snap (in sequence) into the annular finger-receiving channel formed in the body as suggested in FIGS. 17-19 to retain the flip-top cap in a closed position on the body and produce a tamper-evident closure as shown in FIG. 9 that is ready to be coupled to a container as suggested in FIG. 1.
Figure 13B:
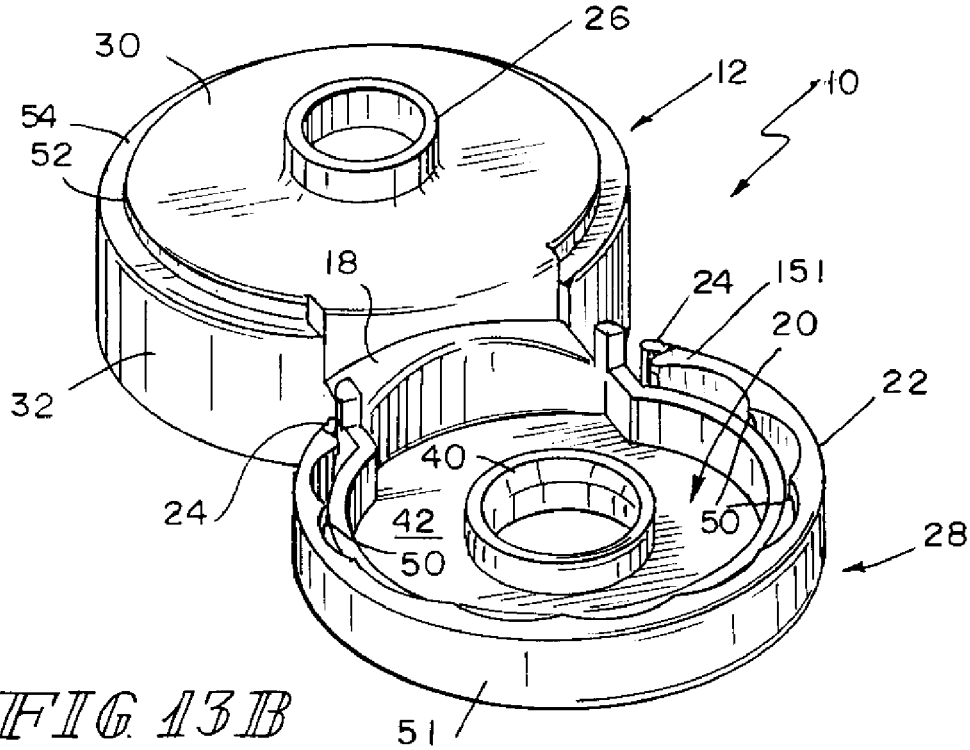

Closure 10 is monolithic and thus is formed as a single piece of plastics material, in three sections, to include body 12, a lid unit 28 comprising flip-top cap 20 and tear strip 22, and a hinge 18 located between body 12 and flip-top cap 20 as shown best in FIGS. 13A and 13B. Closure 10 is formed using any suitable injection-molding or compression-molding technique. During an assembly process at a factory, lid unit 28 is coupled to body 12 to cause flip-top cap 20 to close product-dispensing spout 26 formed in body 12 and to cause the tear strip 22 that is already connected to flip-top cap 20 to be connected to body 12 in a manner shown, for example, in FIGS. 16-19.

Body 12 includes a top wall 30 formed to include product-dispensing spout 26 and an annular side wall 32 depending from a perimeter portion of top wall 30 as suggested in FIGS. 2, 13, 14, and 16. In the illustrated embodiment, an interior surface of annular side wall 32 is threaded or otherwise configured as suggested in FIG. 2 to mate with a companion finish on an exterior surface of container neck 14 to mount tamper-evident closure 10 on container neck 14. It is within the scope of this disclosure to provide any suitable fluid seal on the underside of top wall 30 or elsewhere on body 12 to establish a sealed connection between body 12 and container neck 14 when closure 10 is mounted on container neck 14.

Flip-top cap 20 includes a top wall 34, an annular perimeter side wall 36 depending from a peripheral portion of top wall 34 as suggested in FIGS. 2, 4A, 10, and 11, and a radially outwardly extending lift tab 38. Lift tab 38 is appended to annular side wall 36 in a location adjacent to top wall 34 and opposite to hinge 18 as suggested in FIGS. 1, 2, and 8. Lift tab 38 is received in a cutaway channel 138 formed in tear strip 22 when tear strip 22 is retained in the temporary anchored position on flip-top cap 20 as shown in FIG. 6.

Figure 10:
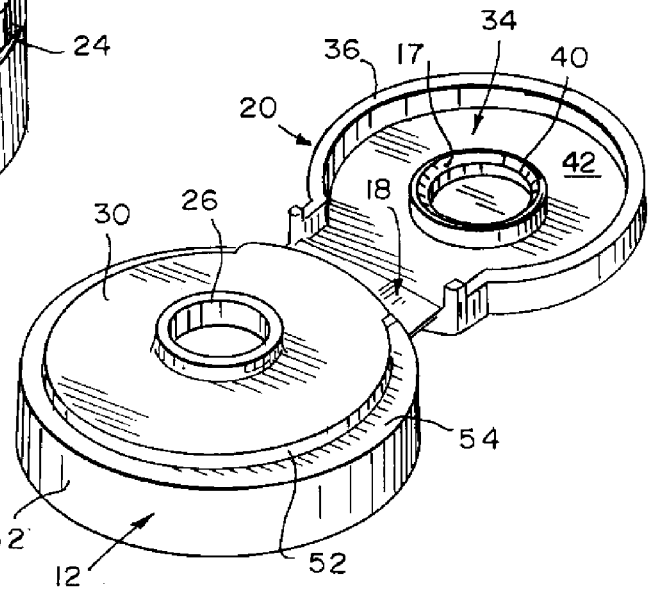
FIG. 10 is a first perspective view of the tamper-evident closure of FIG. 9 after separation of the tear strip and movement of the flip-top cap on the hinge relative to the body to an opened position exposing the product-dispensing spout formed in the body and showing the hinge interconnecting the body and the flip-top cap and a spout grip formed on the underside of the flip-top cap for closing and gripping the product-dispensing spout formed on the body to retain the flip-top cap in a closed position on the body after separation of the tear strip as suggested in FIG. 12.
Figure 11:
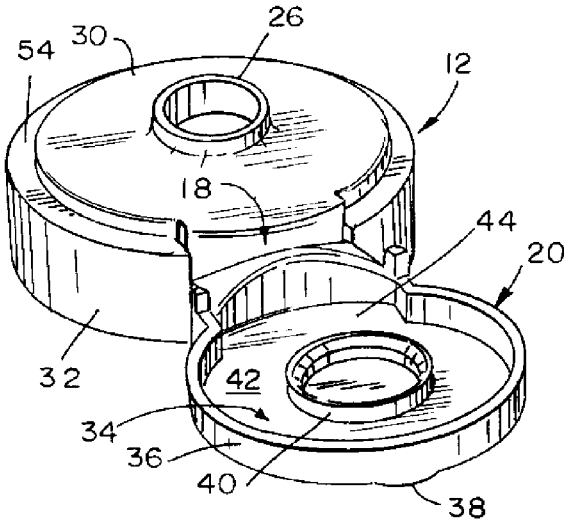
FIG. 11 is a second perspective view similar to FIG. 10.
Figure 12:
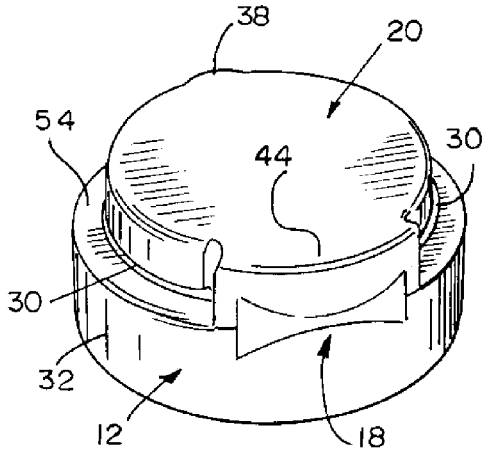
FIG. 12 is a perspective view similar to FIG. 11 after movement of the flip-top cap on the hinge relative to the body to a closed position covering the product-dispensing spout formed in the body after separation of the tear strip.

Flip-top cap 20 also includes a spout grip 40 provided on an underside 42 of top wall 34 of flip-top cap 20 as shown, for example, in FIGS. 10 and 11. Spout grip 40 is sized and shaped to mate with product-dispensing spout 26 formed on body 12 to retain flip-top cap 20 in a closed position on body 12 as shown, for example, in FIG. 2. In one embodiment, spout grip 40 is ring-shaped and arranged to receive and surround product-dispensing spout 26 as shown, for example, in FIG. 3 when flip-top cap 20 is moved to cover and close product-dispensing spout 26. It is also within the scope of this disclosure to configure spout grip 40 to fit inside product-dispensing spout 26 to establish a sealed closure therebetween. It is within the scope of this disclosure to establish a releasable interference fit or other suitable coupling between spout 26 and spout grip 40. As suggested in FIG. 12, such an interference fit acts to retain flip-top cap 20 in a closed position on body 12 whenever tear strip 22 has been separated from an initial position on body 12 and flip-top cap 20 shown, for example, in FIGS. 1-3 and 9.

Figure 3:
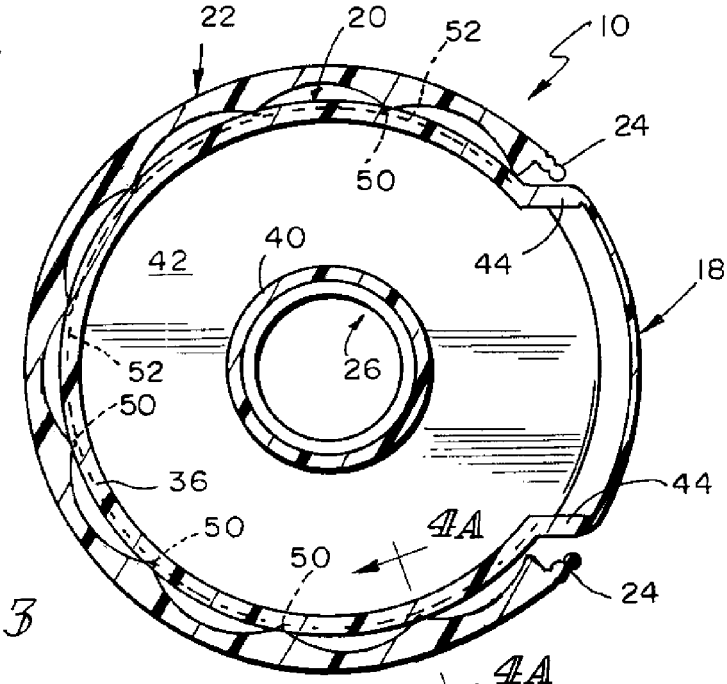
FIG. 3 is an enlarged sectional view taken along line 3-3 of FIG. 2 showing a hinge mount on the right side of the flip-top cap and showing the tear strip extending partly about the annular perimeter exterior side wall of the flip-top cap from about a 4 o'clock position adjacent to one side of the hinge mount to about a 2 o'clock position adjacent to another side of the hinge mount.
Figure 15:
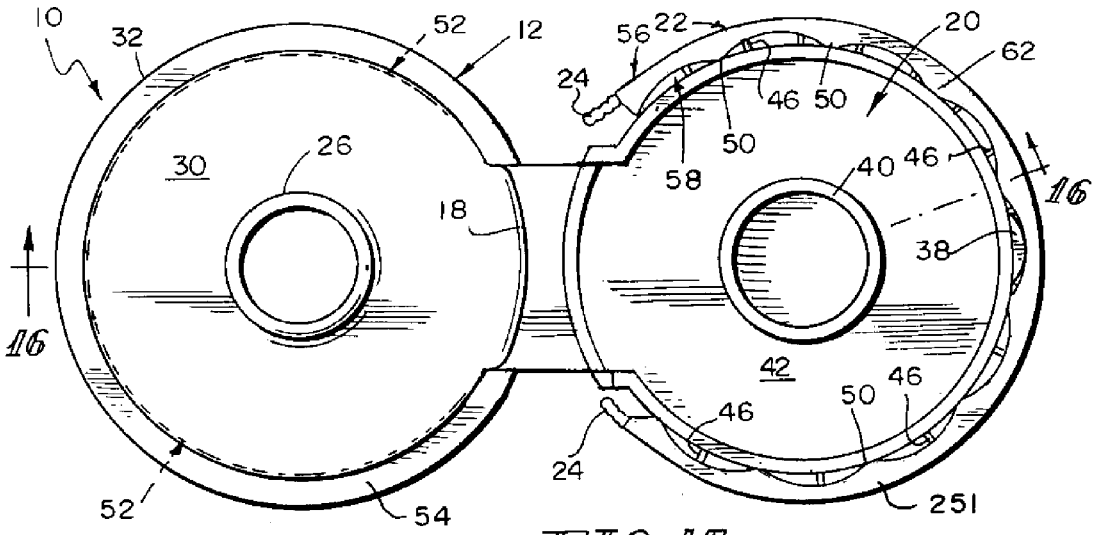
FIG. 15 is a top plan view of the opened tamper-evident closure of FIGS. 13A, 13B, and 14.
Figure 16:
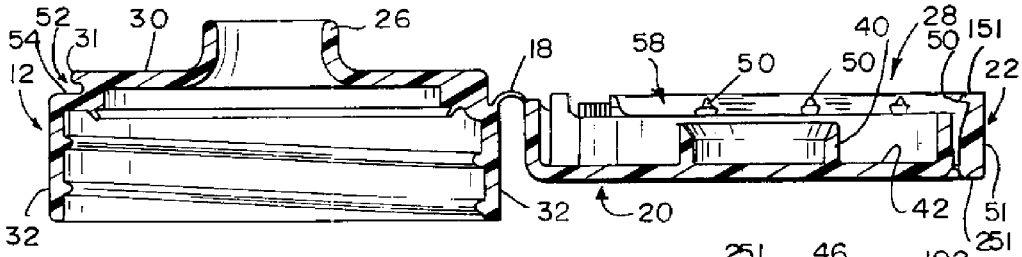
FIG. 16 is a sectional view taken along line 16-16 of FIG. 15.

Hinge 18 is coupled to body 12 and to flip-top cap 20 to provide a "living" hinge as shown best in FIGS. 15 and 16. Hinge 18 is flexible allowing tethered movement of flip-top cap 20 relative to body 12 after separation of tamper-evident tear strip 22. In the illustrated embodiment, flip-top cap 20 includes a radially outwardly projecting hinge mount 44 arranged to lie in an arcuate space between opposing thumb-pull tabs 24 of tear strip 22 as shown in FIGS. 1 and 3. One end of hinge 18 is appended to hinge mount 44 as suggested in FIGS. 1 and 16 during formation of closure 10. An opposite end of hinge 18 is appended to side wall 32 of base 12 as suggested, for example, in FIGS. 2, 9, and 11.

Any suitable number of frangible connectors 46 can be provided to couple tear strip 22 to flip-top cap 20 initially during formation of tamper-evident closure 10. In the illustrated embodiment, as shown in FIGS. 4A, 5A, 5B, 6, and 15, each frangible connector 46 is coupled at an inner end to annular perimeter side wall 36 of flip-top cap 20 and at an outer end to tear strip 22. Frangible connectors 46 are circumferentially spaced apart from one another in the embodiment shown in FIGS. 5A, 5B, and 6. Those frangible connectors 46 cooperate to retain tear strip 22 in the initial position on flip-top cap 20 shown in FIGS. 13A, 13B, and 14, yet fracture or break easily when tear strip 22 is pulled by a consumer in the manner suggested in FIGS. 6-8 when that consumer desires to release flip-top cap 20 so that cap 20 can be moved to the opened position exposing product-dispensing spout 26 in body 12 for the first time.

Tear strip 22 also is configured to be releasably coupled to body 12 to help retain flip-top cap 20 in the closed position on body 12 until later separation of tear strip 22 from the rest of closure 10. In the illustrated embodiment, tear strip 22 includes an elongated band 51 and a series of radially inwardly extending retention fingers 50 appended to band 51 as shown best in FIGS. 5A and 5B. Retention fingers 50 are arranged to extend into an annular finger-receiving undercut 52 (i.e., channel) formed in body 12 and opening radially outwardly toward band 51 of tear strip 22 as suggested, for example, in FIGS. 3 and 4A.

The annular finger-receiving channel 52 formed in body 12 is shown, for example, in FIGS. 4B, 10, 11, 13A, 13B, and 14. Channel 52 is arranged to extend around and just under an annular peripheral lip 31 of round top wall 30 of body 12. Body 12 also includes an annular or curved landing 54 arranged to surround finger-receiving channel 52 as shown in FIGS. 10 and 11 and to merge with an upper portion of annular side wall 32 of body 12.

Figure 14:
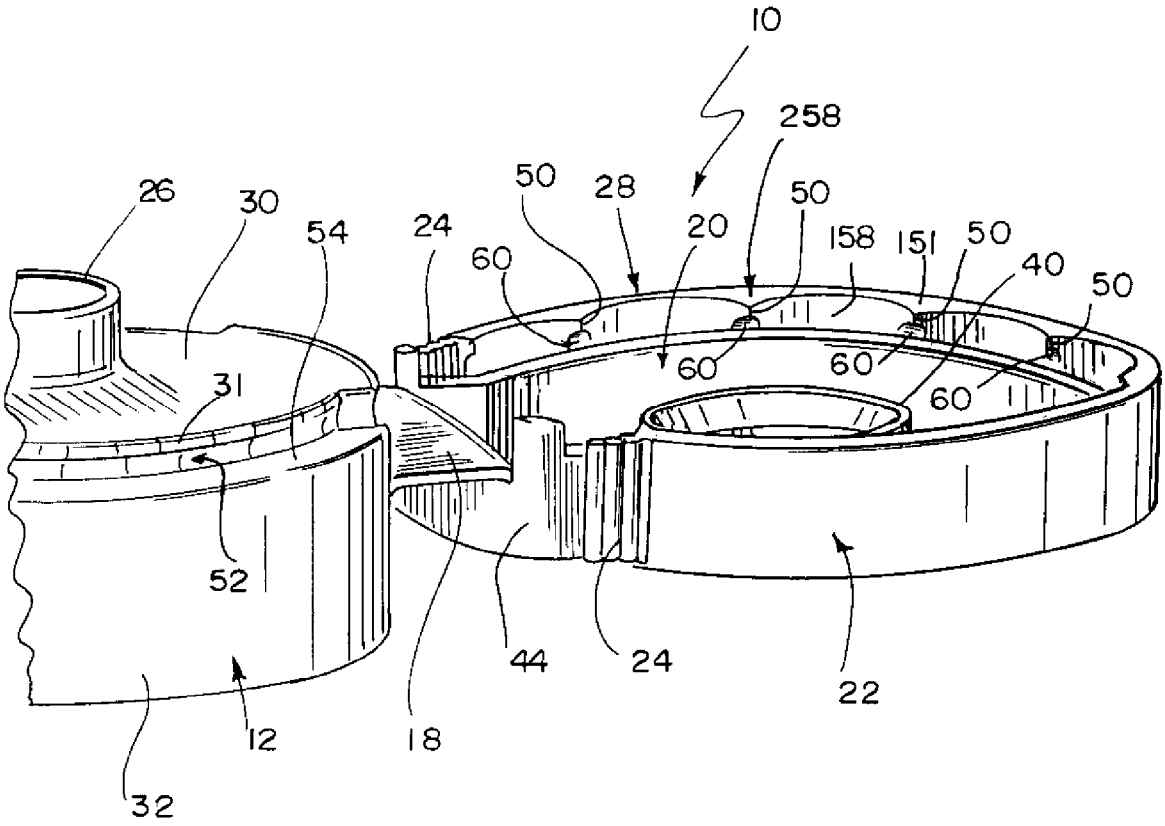
FIG. 14 is another perspective view of the opened tamper-evident closure of FIGS. 13A and 13B shoving a portion of the annular finger-receiving channel formed in the body and five of the circumferentially spaced-apart radially inwardly extending retention fingers formed on a "bottom" portion of the tear strip.

The radially inwardly extending retention fingers 50 included in tear strip 22 are shown best in FIGS. 5B, 8, and 14. These retention fingers 50 are arranged to lie in circumferentially spaced-apart relation to one another when the tear strip 22 is formed on flip-top cap 20 as suggested in FIG. 16. Retention fingers 50 are arranged to extend into finger-receiving channel 52 formed in body 12 to limit movement of flip-top cap 20 relative to body 12 from the closed position shown, for example, in FIGS. 1, 2, and 9 toward the opened position shown in FIG. 10 until tear strip 22 is separated from body 12 in response to fracture of frangible connectors 46 as shown, for example, in FIGS. 6-8. In illustrative embodiments, frangible connectors 46 provide means for retaining tear strip 22 in a "temporary" anchored position on flip-top cap 20 as shown, for example, in FIGS. 5A and 9.

An illustrative embodiment of tear strip 22 is shown in FIGS. 5A and 5B. Tear strip 22 includes a curved band 51, retention fingers 50 coupled to curved band 51, a connector support ridge 200 comprising a series of connector supports 146 coupled to curved band 51, and thumb-pull tabs 24 coupled to opposite ends of curved band 51.

Figure 4A:
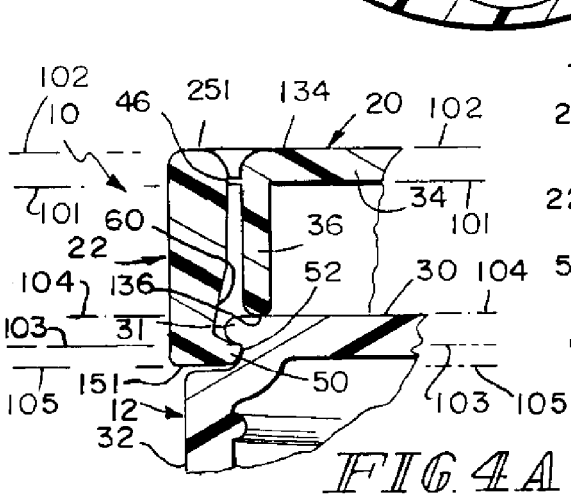
FIG. 4A is a sectional view taken along line 4A-4A of FIG. 3 showing one of the frangible connectors interconnecting a top portion of the tear strip and an upper perimeter portion of the flip-top cap and showing one of the radially inwardly extending retention fingers extending from the tear strip into an undercut (i.e., finger-receiving channel) formed in the body to anchor the tear strip to the body and cap so as to define a tamper-evident coupling retaining the flip-top cap in the spout-closing position on the body shown in FIGS. 1 and 2.
Figure 4B:
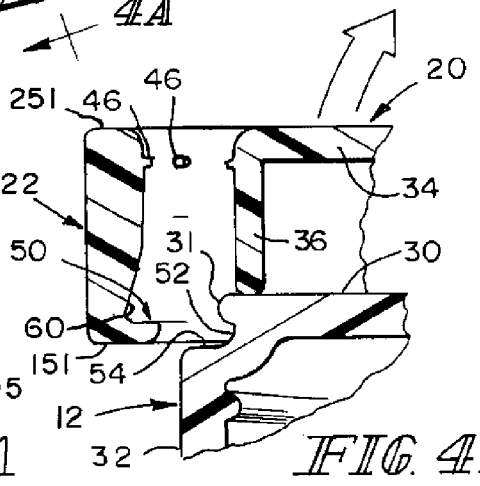
FIG. 4B is a sectional view similar to FIG. 4A after separation of the tear strip from the body and the flip-top cap and showing "breakage" of two of the frangible connectors and removal of one of the radially inwardly extending retention fingers on the tear strip from the finger-receiving channel formed in the body owing to separation of the tear strip from other portions of the tamper-evident closure and suggesting freedom of the flip-top cap to move upwardly in the direction of the arrow away from the body of the closure.
Figure 9:
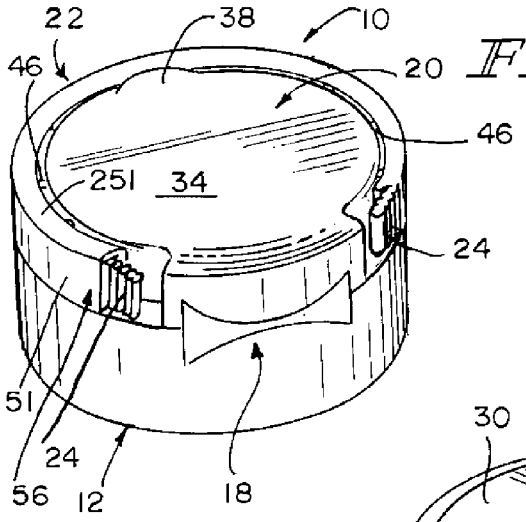
FIG. 9 is an enlarged perspective view of the tamper-evident closure of FIG. 1 showing the tear strip coupled to the base and to the flip-top cap.

Curved band 51 has a bottom rim 151 arranged to face toward annular landing 54 of body 12 when tear strip 22 is retained in the temporary anchored position and flip-top cap 20 is in the closed position as shown, for example, in FIG. 4A. Curved band 51 also has a top rim 251 arranged to face away from annular landing 54 of body 12 and lie adjacent to top wall 34 of flip-top cap 20 in the position illustrated in FIG. 4A.

Retention fingers 50 are arranged to lie adjacent to or near (i.e., next to) bottom rim 151 of curved band 51 to extend into finger-receiving channel 52 formed in body 12 as shown best in FIGS. 2A and 4A. In this way, retention fingers 50 engage an underside of lip 31 on body 12 to retain flip-top cap 20 in the closed position on body 12 as long as tear strip 22 remains in the temporary anchored position on flip-top cap 20 and frangible connectors 46 remain unbroken. Bottom and top rims 151, 251 of curved band 51 are also shown in FIGS. 5A and 5B.

Connector supports 146 are arranged to lie adjacent to or near (i.e., next to) top rim 251 of curved band 51 and each frangible connector 46 is coupled to an inwardly facing edge 246 of one of connector supports 146 as suggested in FIGS. 5A and 5B. In an illustrative embodiment, each connector support 146 is a crescent-shaped thin plate having a concave curved inwardly facing edge 246 as shown, for example, in FIG. 5B.

In the illustrated embodiment, curved band 51 has a curved outer wall 56 and a curved scalloped inner wall 58 comprising concave curved segments 158 and undercut segments 60. As suggested in FIG. 5B, an undercut segment 60 and adjacent curved segments 158 merge to form a radially inwardly extending "wave-crest" portion 258 and cooperate to form one of retention fingers 50 at each wave-crest portion 258.

As shown diagrammatically in FIG. 4A, flip-top cap 20 includes a top wall 34 appended to perimeter side wall 36. Frangible connectors 46 are arranged to lie in a first plane 101 in close proximity to a second plane 102 established by an exterior surface 134 of top wall 34 of flip-top cap 20. Retention fingers 50 are arranged to lie in a third plane 103 positioned to lie in spaced-apart relation to second plane 102 to locate first plane 101 between second and third planes 102, 103 as shown in FIG. 4A. Perimeter side wall 36 of flip-top cap 20 includes a bottom edge 136 arranged to mate with top wall 30 of body 12 upon movement of flip-top cap 20 to assume the closed position and to lie in a fourth plane 104 positioned to lie between first and third planes 101, 103 as shown in FIG. 4A. Bottom rim 151 of band 51 is arranged to lie in a fifth plane 105 and top rim 251 of band 51 is arranged to lie in second plane 102 as shown in FIG. 4A.

Tear strip 22 can be separated from body 12 and flip-top cap 20 easily using either or both of thumb-pull tabs 24 in a manner shown, for example, in FIGS. 6-8. This motion breaks each of frangible connectors 46 and withdraws each of retention fingers 50 from annular finger-receiving channel 52 formed in body 12 in the manner suggested, for example, in FIG. 4B. Once tear strip 22 has been separated, flip-top cap 20 is retained in the closed position on body 12 shown in FIG. 12 only by engagement of spout grip 40 formed on the underside of flip-top cap 20 and product-dispensing spout 26 formed in body 12. Flip-top cap 20 can now be moved relative to body 12 on hinge 18 back and forth between the opened and closed positions easily at the option of the consumer. It is also within the scope of this disclosure to use only one thumb-pull tab 24 at either a left end or a right end of tear strip 22.

A preformed lid unit 28 comprising flip-top cap 20 and tear strip 22 is coupled to body 12 at a closure manufacturing factory using, for example, an assembly technique illustrated in FIGS. 16-19. In the illustrated embodiment, an apparatus comprising a support base 101 and a cap closer 102 mounted for movement relative to support base 101 is provided to couple lid unit 28 to body 12.

Figure 17:
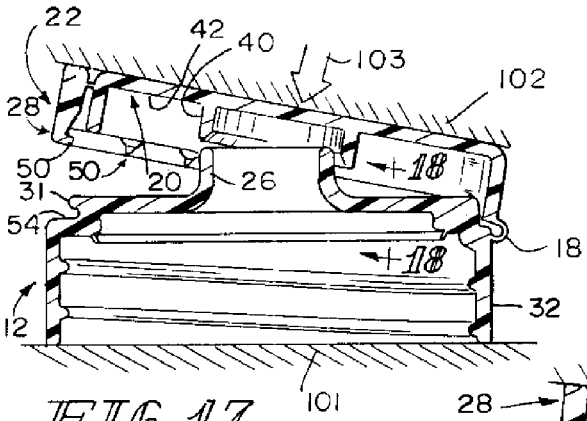
FIG. 17 is a sectional view similar to FIG. 16 showing the body at rest on an underlying "support base" and movement of a "cap closer" in engagement with top portions of the flip-top cap and the tear strip to pivot those two components as a unit on the hinge about a pivot axis established by the hinge toward mating engagement with the underlying body at a closure assembly station in a closure manufacturing factory.
Figure 18:
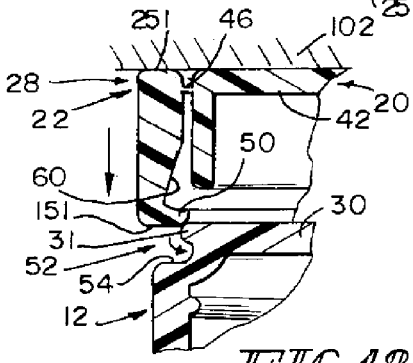
FIG. 18 is an enlarged sectional view taken along line 18-18 of FIG. 17 suggesting a "snap-engagement" form of movement of one of the radially inwardly extending retention fingers on the tear strip into the finger-receiving channel formed in the body.
Figure 19:
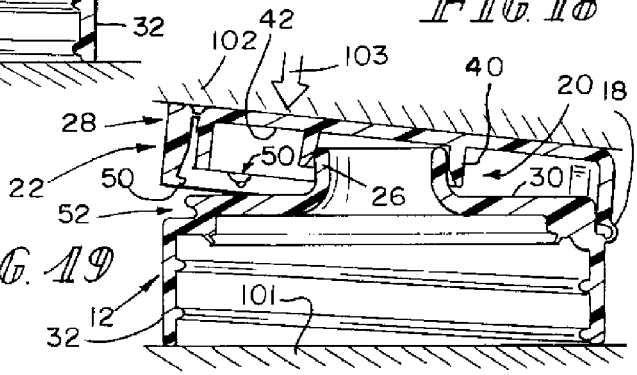
FIG. 19 is a sectional view similar to FIG. 17 showing further pivoting movement of the flip-top cap and tear strip unit on the hinge toward the body to cause a few more of the radially inwardly extending retention fingers to snap into the finger-receiving channel formed in the body.

Using the illustrative technique, body 12 is placed on support base 101, cap closer 102 is arranged to engage flip-top cap 20 and tear strip 22, and cap closer 102 is then moved relative to support base 101 to apply a force 103 to lid unit 28 as suggested, for example, in FIG. 17. Continued movement of cap closer 102 toward support base 101 will cause each radially inwardly extending retention finger 50 to override a "rounded" or "chamfered" lip 31 on body 12 and above finger-receiving channel 52 and then "snap" into finger-receiving channel 52 as suggested in FIG. 18 without breaking any of frangible connectors 46 linking tear strip 22 to flip-top cap 20. Retention fingers 50 will be urged into finger-receiving channel 52 in groups of two as the included angle between cap closer 102 and support base 101 is lessened so that it is not necessary to insert all of retention fingers 50 into finger-receiving channel 52 at the same time. This "staged" insertion of retention fingers 50 into channel 52 is suggested in FIGS. 17 and 19.

Figure 20A:
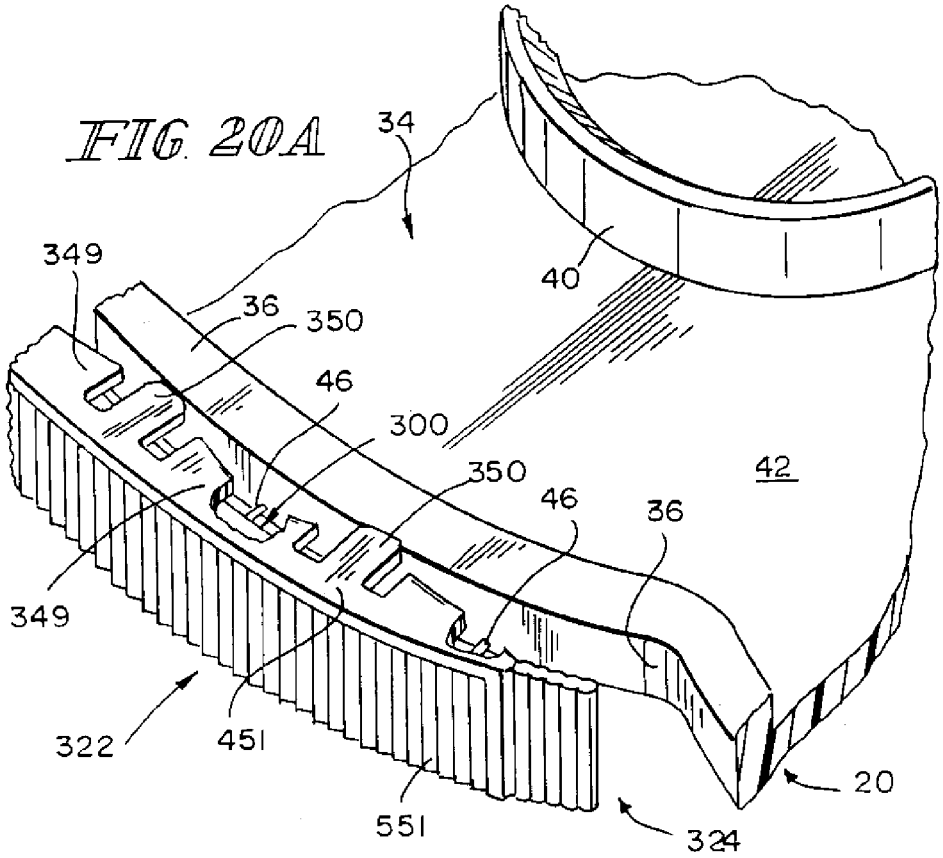
FIG. 20A is a perspective view similar to FIG. 5A of a portion of a tamper-evident closure including a tear strip in accordance with another illustrative embodiment of the disclosure showing the "inverted" tear strip in a temporary anchored position in a flip-top cap and showing two radially inwardly extending retention fingers cantilevered to a "bottom" portion of the tear strip.
Figure 20B:
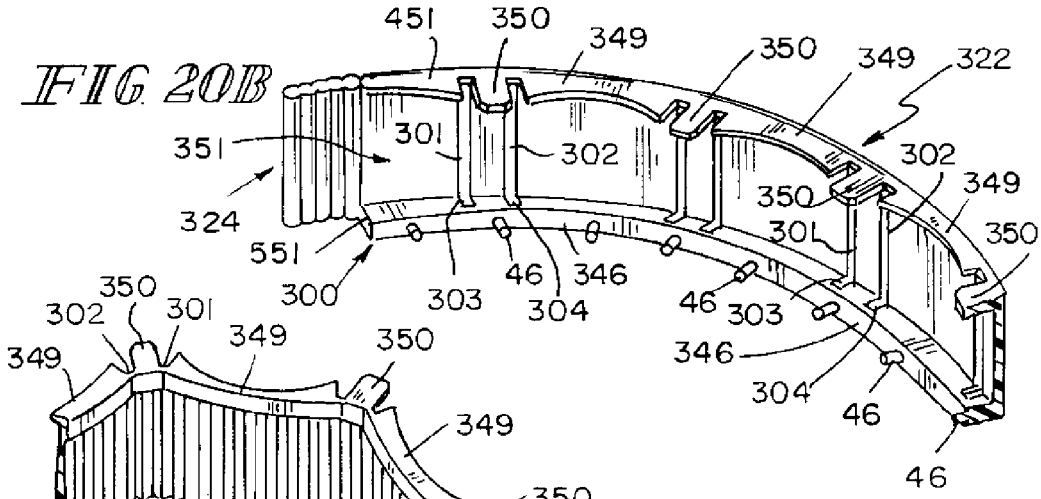
FIG. 20B is a perspective view similar to FIG. 5B of a portion of the inverted tear strip shown in FIG. 20A showing eight "broken" frangible connectors appended to a curved inner edge of a connector support ridge provided along a "top" portion of the tear strip, Showing four retention fingers formed in a "bottom" portion of the tear strip, and showing various vertical and horizontal channels formed on an interior portion of the tear strip to provide enhanced deformation of the tear strip following separation from the flip-top cap.
Figure 20C:
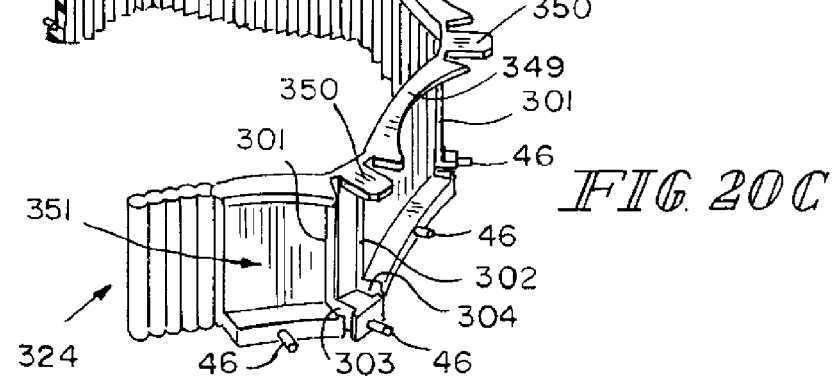
FIG. 20C is a perspective view of the inverted tear strip of FIGS. 20A and B after it has been separated from the flip-top cap and "deformed"

An illustrative embodiment of an "inverted" tear strip 322 in accordance with a second embodiment of the present disclosure is shown in FIGS. 20A-C. Tear strip 322 includes a curved band 351, retention fingers 350 coupled to curved band 351, a connector support ridge 300 coupled to curved band 351, and thumb-pull tabs 324 coupled to opposite ends of curved band 351.

Curved band 351 has a bottom rim 451 arranged to face toward annular landing 54 of body 12 when tear strip 322 is retained in the temporary anchored position and flip-top cap 20 is in the closed position. Curved band 351 also has a top rim 551 arranged to face away from annular landing 54 of body 12 and lie adjacent to top wall 34 of flip-top cap 20 in the closed position.

Retention fingers 350 are cantilevered to bottom rim 451 to extend at about a right angle to curved band 351 and arranged to extend into finger-receiving channel 52 formed in body 12 when tear strip 322 is retained in the temporary anchored position and flip-top cap 20 is in the closed position. In this way, retention fingers 350 engage an underside of lip 31 on body 12 to retain flip-top cap 20 in the closed position on body 12 as long as tear strip 322 remains in the temporary anchored position on flip-top cap 20 and frangible connectors 46 remain unbroken. Curved horizontal plates 349 are cantilevered to bottom rim 451 as shown in FIG. 20B and each curved horizontal plate 349 is positioned to lie in a space between each pair of adjacent retention fingers 350 as shown, for example, in FIG. 20B.

Connector support ridge 300 includes a concave, curved, inwardly facing edge 346. Each frangible connector 46 is coupled at one end to edge 346 of connector support ridge 300.

Deformation of tear strip 322 during separation from flip-top cap 20 is enhanced by formation of various slots and channels shown in FIGS. 20A-C. For example, curved band 351 includes vertical channels 301 and 302 arranged to lie in spaced-apart relation to one another to "locate" one of retention fingers 350 therebetween and connector support ridge 300 includes two horizontal channels 303 and 304 arranged to provide "extensions" of associated vertical channels 301 and 302. The channels 301-304 are configured, sized, and arranged to weaken tear strip 322 to provide enhanced deformation of tear strip 322 during separation from flip-top cap 20. This enhanced deformation is shown, for example, in FIG. 20C.

Figure 21A:
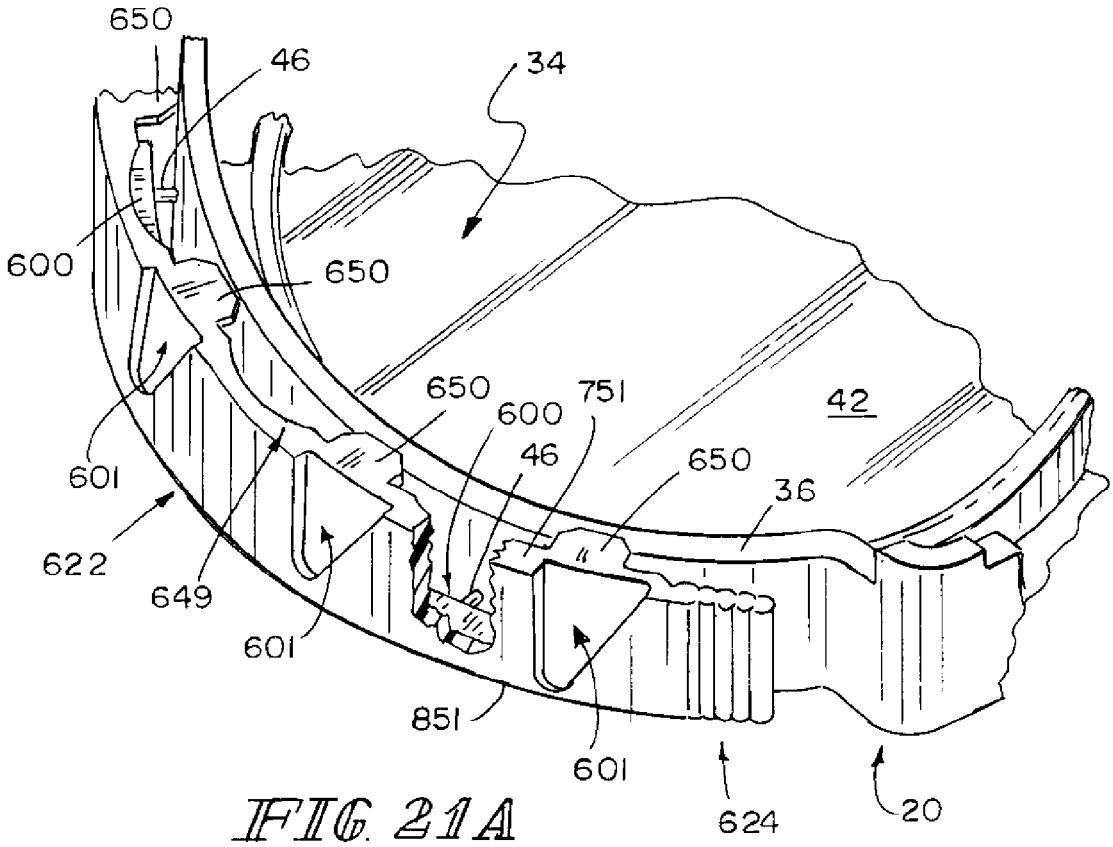
FIG. 21A is a perspective view similar to FIGS. 5A and 20A of a portion of a tamper-evident closure including a tear strip in accordance with yet another illustrative embodiment of the disclosure showing the "inverted" tear strip in a temporary anchored position on a flip-top cap and showing three triangle-shaped depressions formed on an exterior portion of the tear strip to provide enhanced deformation of the tear strip following separation from the flip-top cap.
Figure 21B:
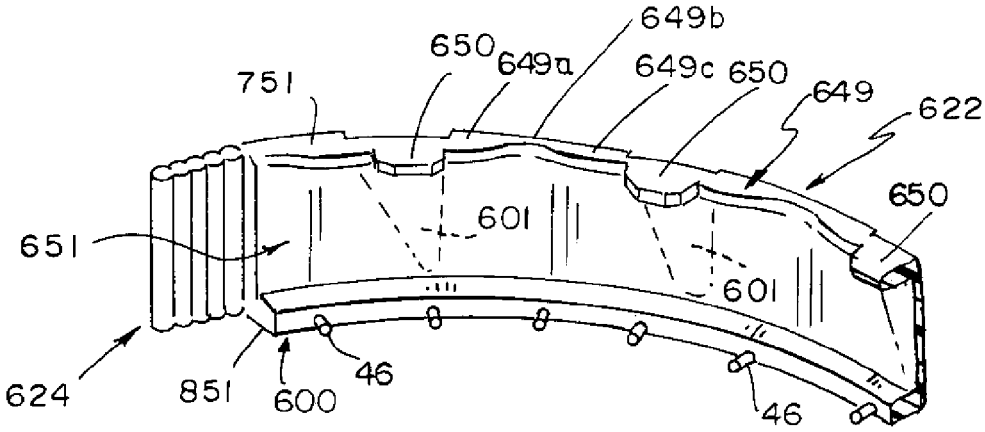
FIG. 21B is a perspective view similar to FIG. 5B and 20B of the inverted tear strip shown in FIG. 21A showing six "broken" frangible connectors appended to a curved inner edge of a connector support ridge provided along a "top" portion of the tear strip and showing three retention fingers formed in a "bottom" portion of the tear strip.

An illustrative embodiment of an "inverted" tear strip 622 in accordance with a third embodiment of the present disclosure is shown in FIGS. 21A and 21B. Tear strip 622 includes a curved band 651, retention fingers 650 coupled to curved band 651, a connector support ridge 600 coupled to curved band 651, and thumb-pull tabs 624 coupled to opposite ends of curved band 651.

Curved band 651 has a bottom rim 751 arranged to face toward annular landing 54 of body 12 when tear strip 622 is retained in the temporary anchored position and flip-top cap 20 is in the closed position. Curved band 651 also has a top rim 851 arranged to face away from annular landing 54 of body 12 and lie adjacent to top wall 34 of flip-top cap 20 in the closed position.

Retention fingers 650 are cantilevered to bottom rim 751 to extend at about a right angle to curved band 651 and arranged to extend into finger-receiving channel 52 formed in body 12 when tear strip 622 is retained in the temporary anchored position and flip-top cap 20 is in the closed position. In this way, retention fingers 650 engage an underside of lip 31 on body 12 to retain flip-top cap 20 in the closed position on body 12 as long as tear strip 622 remains in the temporary anchored position on flip-top cap 20 and frangible connectors 46 remain unbroken. Horizontal plates 649 are cantilevered to bottom rim 751 as shown in FIG. 21B and each horizontal plate 649 is positioned to lie in a space and extend between each pair of adjacent retention fingers 650 as shown, for example, in FIG. 21B. Each horizontal plate 649 includes an inwardly facing edge 749 formed to include a depression 749*b* located between two spaced-apart protrusions 749*a* and 749*c*.

Connector support ridge 600 includes a concave, curved, inwardly facing edge 646. Each frangible connector 46 is coupled at one end to edge 646 of connector support ridge 600.

Deformation of tear strip 622 during separation from flip-top cap 20 is enhanced by formation of depressions 601 on an exterior portion of tear strip 622. Each depression 601 is triangle-shaped and aligned with one of the retention fingers 650 as shown in FIG. 21A.

The invention claimed is:

1. A tamper-evident closure comprising a body formed to include a product-dispensing spout and adapted to mount on a container filler neck, the body being formed to include a finger-receiving channel, a lid unit including a flip-top cap, a tear strip extending around a perimeter side wall of the flip-top cap, and frangible connectors coupled to the flip-top cap and to the tear strip to retain the tear strip in a temporary anchored position on the flip-top cap, a hinge coupled to the body and to the flip-top cap to support the flip-top cap for movement relative to the body from a closed position on the body covering the product-dispensing spout to an opened position away from the body uncovering the product-dispensing spout, the tear strip including retention fingers arranged to extend into the finger-receiving channel formed in the body to limit movement of the flip-top cap relative to the body from the closed position toward the opened position until the tear strip is separated from the body to leave the temporary anchored position in response to fracture of the frangible connectors, and wherein the tear strip includes a curved band formed to include the retention fingers and a connector support ridge coupled to the curved band and wherein the frangible connectors are coupled to the connector support ridge.

2. The closure of claim 1, wherein the connector support ridge includes a concave curved inwardly facing edge arranged to lie in close proximity and spaced-apart relation to a convex curved portion of the perimeter side wall of the flip-top cap and each frangible connector includes an outer end coupled to the concave curved inwardly facing edge of the connector support ridge and an inner end coupled to the convex curved portion of the perimeter side wall of the flip-top cap.

3. The closure of claim 2, wherein the flip-top cap includes a top wall, the perimeter side wall of the flip-top cap includes an upper section depending from a perimeter portion of the top wall, and the frangible connectors are coupled to the upper section.

4. A tamper-evident closure comprising a body formed to include a product-dispensing spout and adapted to mount on a container filler neck, the body being formed to include a finger-receiving channel, a lid unit including a flip-top cap, a tear strip extending around a perimeter side wall of the flip-top cap, and frangible connectors coupled to the flip-top cap located to retain the tear strip in a circumferentially spaced temporary anchored position on the flip-top cap, the frangible connectors being in close proximity to a top rim of the cap, and a hinge coupled to the body and to the flip-top cap to support the flip-top cap for movement relative to the body from a closed position on the body covering the product-dispensing spout to an opened position away from the body uncovering the product-dispensing spout, the tear strip including retention fingers arranged to extend into the finger-receiving channel formed in the body to limit movement of the flip-top cap relative to the body from the closed position toward the opened position until the tear strip is separated from the body to leave the temporary anchored position in response to fracture of the frangible connectors wherein the flip-top cap further includes a top wall appended to the perimeter side wall, the frangible connectors are arranged to lie in a first plane in close proximity to a second plane established by an exterior surface of the top wall of the flip-top cap, the retention fingers are arranged to lie in a third plane positioned to lie in spaced-apart relation to the second plane to locate the first plane between the second and third planes, and wherein the perimeter side wall includes a bottom edge arranged to mate with the body upon movement of the flip-top cap to assume the closed position and to lie in a fourth plane positioned to lie between the first and third planes.

5. The closure of claim 4, wherein the tear strip includes a curved band formed to include the retention fingers and a connector support ridge coupled to the curved band and wherein the frangible connectors are coupled to the connector support ridge.

6. The closure of claim 5, wherein the curved band includes a top rim arranged to lie in the second plane and a bottom rim arranged to lie in a fifth plane, the connector support ridge includes an inwardly facing edge located between the fourth and fifth planes, and each frangible connector includes an outer end coupled to the inwardly facing edge and an inner end coupled to the perimeter side wall of the flip-top cap.

7. The closure of claim 4, wherein the flip-top cap further includes a radially outwardly extending lift tab coupled to the perimeter side wall and arranged to lie in the second plane and wherein the tear strip is formed to include a cutaway channel receiving the radially outwardly extending lift tab therein when the tear strip is retained in the temporary anchored position on the flip-top cap.

8. A tamper-evident closure comprising a body formed to include a product-dispensing spout and adapted to mount on a container filler neck, the body being formed to include a finger-receiving channel, a lid unit including a flip-top cap, a tear strip extending around a perimeter side wall of the flip-top cap, and frangible connectors coupled to the flip-top cap and to the tear strip to retain the tear strip in a temporary anchored position on the flip-top cap, a hinge coupled to the body and to the flip-top cap to support the flip-top cap for movement relative to the body from a closed position on the body covering the product-dispensing spout to an opened position away from the body uncovering the product-dispensing spout, the tear strip including retention fingers arranged to extend into the finger-receiving channel formed in the body to limit movement of the flip-top cap relative to the body from the closed position toward the opened position until the tear strip is separated from the body to leave the temporary anchored position in response to fracture of the frangible connectors, and wherein the tear strip includes a bottom rim arranged to face in a first direction downwardly toward a horizontal landing formed on the body when the flip-top cap is moved to assume the closed position and the tear strip is retained in the temporary anchored position, the tear strip further includes a top rim arranged to face in an opposite second direction, the frangible connectors are arranged to lie in close proximity to the top rim, and the retention fingers are arranged to lie in spaced-apart relation to the frangible connectors and in close proximity to the bottom rim.

9. A tamper-evident closure comprising a body formed to include a product-dispensing spout and adapted to mount on a container filler neck, the body being formed to include a finger-receiving channel, a lid unit including a flip-top cap, a tear strip extending around a perimeter side wall of the flip-top cap, and frangible connectors coupled to the flip-top cap and to the tear strip to retain the tear strip in a temporary anchored position on the flip-top cap, a hinge coupled to the body and to the flip-top cap to support the flip-top cap for movement relative to the body from a closed position on the body covering the product-dispensing spout to an opened position away from the body uncovering the product-dispensing spout, the tear strip including retention fingers arranged to extend into the finger-receiving channel formed in the body to limit movement of the flip-top cap relative to the body from the closed position toward the opened position until the tear strip is separated from the body to leave the temporary anchored position in response to fracture of the frangible connectors, and wherein the tear strip includes a curved band formed to include the retention fingers and a connector support ridge coupled to the curved band and wherein the frangible connectors are coupled to the connector support ridge, the curved band includes a scalloped inner wall arranged to extend around and face toward the finger-receiving channel formed in the body upon movement of the flip-top cap to assume the closed position, the connector support ridge includes a series of connector supports, each connector support is coupled to the scalloped inner wall and formed to include an inwardly facing edge, and the frangible connectors are coupled to the inwardly facing edges of the connector supports.

10. The closure of claim 9, wherein each connector support is a crescent-shaped thin plate.

11. The closure of claim 9, wherein the inwardly facing edge of each connector support is a concave curved surface.

12. The closure of claim 9, wherein the scalloped inner wall of the curved band includes a concave first curved segment arranged to lie adjacent to a concave second curved segment to form a wave-crest portion therebetween, the wave-crest portion is arranged to extend in a radially inward direction toward the finger-receiving channel formed in the body upon movement of the flip-top cap to assume the closed position, and the scalloped inner wall further includes an undercut segment located at the wave-crest portion and configured to cooperate with the concave first and second curved segments to form one of the retention fingers.

13. A tamper-evident closure comprising a body formed to include a product-dispensing spout and adapted to mount on a container filler neck, the body being formed to include a finger-receiving channel, a lid unit including a flip-top cap, a tear strip extending around a perimeter side wall of the flip-top cap, and frangible connectors coupled to the flip-top cap and to the tear strip to retain the tear strip in a temporary anchored position on the flip-top cap, a hinge coupled to the body and to the flip-top cap to support the flip-top cap for movement relative to the body from a closed position on the body covering the product-dispensing spout to an opened position away from the body uncovering the product-dispensing spout, the tear strip including retention fingers arranged to extend into the finger-receiving channel formed in the body to limit movement of the flip-top cap relative to the body from the closed position toward the opened position until the tear strip is separated from the body to leave the temporary anchored position in response to fracture of the frangible connectors, and wherein the tear strip includes a curved band formed to include the retention fingers and a connector support ridge coupled to the curved band and wherein the frangible connectors are coupled to the connector support ridge, the body includes an exterior side wall, a radially inwardly extending curved landing arranged to merge with an upper portion of the exterior side wall, and a top wall formed to include a peripheral lip arranged to lie above and in spaced-apart relation to the radially inwardly extending curved landing to define the finger-receiving channel therebetween, and wherein the curved band has a bottom rim arranged to face toward and lie in close proximity to the radially inwardly extending curved landing when the tear strip is retained in the temporary anchored position on the flip-top cap and the flip-top cap has been moved to assume the closed position, the retention fingers are arranged to lie next to the bottom rim, the curved band has a top rim arranged to face away from the radially inwardly extending curved landing, and the connector supports are arranged to lie next to the top rim.

14. A tamper-evident closure comprising a body formed to include a product-dispensing spout and adapted to mount on a container filler neck, the body being formed to include a finger-receiving channel, a lid unit including a flip-top cap, a tear strip extending around a perimeter side wall of the flip-top cap, and frangible connectors coupled to the flip-top cap and to the tear strip to retain the tear strip in a temporary anchored position on the flip-top cap, a hinge coupled to the body and to the flip-top cap to support the flip-top cap for movement relative to the body from a closed position on the body covering the product-dispensing spout to an opened position away from the body uncovering the product-dispensing spout, the tear strip including retention fingers arranged to extend into the finger-receiving channel formed in the body to limit movement of the flip-top cap relative to the body from the closed position toward the opened position until the tear strip is separated from the body to leave the temporary anchored position in response to fracture of the frangible connectors, and wherein the tear strip includes a curved band formed to include the retention fingers and a connector support ridge coupled to the curved band and wherein the frangible connectors are coupled to the connector support ridge, the flip-top cap includes a top wall, the perimeter side wall of the flip-top cap depends from a perimeter portion of the top wall of the flip-top cap, and the frangible connectors are coupled to an upper section of the perimeter side wall adjacent to the perimeter portion of the top wall of the flip-top cap.

15. A tamper-evident closure comprising a body formed to include a product-dispensing spout and adapted to mount on a container filler neck, the body being formed to include a finger-receiving channel, a lid unit including a flip-top cap, a tear strip extending around a perimeter side wall of the flip-top cap, and frangible connectors coupled to the flip-top cap and to the tear strip to retain the tear strip in a temporary anchored position on the flip-top cap, a hinge coupled to the body and to the flip-top cap to support the flip-top cap for movement relative to the body from a closed position on the body covering the product-dispensing spout to an opened position away from the body uncovering the product-dispensing spout, the tear strip including retention fingers arranged to extend into the finger-receiving channel formed in the body to limit movement of the flip-top cap relative to the body from the closed position toward the opened position until the tear strip is separated from the body to leave the temporary anchored position in response to fracture of the frangible connectors, and wherein the tear strip includes a curved band and the retention fingers are cantilevered to the curved band.

16. The closure of claim 15, wherein each retention finger is arranged to lie at about a right angle to the curved band.

17. The closure of claim 15, wherein the tear strip further includes a series of horizontal plates cantilevered to the curved band and each horizontal plate is interposed between each pair of adjacent retention fingers.

18. The closure of claim 15, wherein the tear strip further includes a connector support ridge coupled to the curved band and arranged to underlie the retention fingers and the frangible connectors are coupled to the connector support ridge.

19. The closure of claim 15, wherein the curved band is formed to include first and second vertical channels arranged to lie in spaced-apart relation to one another to locate one of the retention fingers therebetween.

20. The closure of claim 19, wherein the tear strip further includes a connector support ridge coupled to the curved band and arranged to underlie the retention fingers and the frangible connectors are coupled to the connector support ridge and wherein the connector support ridge is formed to include first and second horizontal channels, the first horizontal channel is aligned with and an extension of the first vertical channel, the second horizontal channel is aligned with and an extension of the second vertical channel, and the channels cooperate to define weakened sections in the tear strip to buckle and enhance deformation of the tear strip when the tear strip is separated from the flip-top cap.

21. The closure of claim 15, wherein the curved band is formed to include depressions and each depression has an opening on an exterior portion of the curved band facing away from the flip-top cap.

22. The closure of claim 21, wherein each depression is aligned in registry with one of the retention fingers.

23. The closure of claim 21, wherein each depression is triangle-shaped.

24. The closure of claim 23, wherein each depression is oriented to cause a vertex thereof to lie adjacent to a top rim of the tear strip and a leg thereof to lie adjacent to and along a bottom rim of the tear strip.

25. A tamper-evident closure comprises a body formed to include a top wall, an annular perimeter lip arranged to depend at an upper end thereof from a perimeter edge of the top wall and formed to include a radially outwardly opening finger-receiving channel, a landing arranged to extend in a radially outward direction from a lower end of the annular perimeter lip, and a side wall arranged to extend downwardly from a perimeter edge of the landing, a lid unit including a flip-top cap, a tear strip extending around a perimeter side wall of the flip-top cap, and frangible connectors coupled to the flip-top cap and to the tear strip to retain the tear strip in a temporary anchored position on the flip-top cap, the tear strip including retention fingers, and a curved band formed to include a top rim arranged to face in a first direction and a bottom rim arranged to face in an opposite second direction and a connector support ridge coupled to the top rim, the frangible connectors including outer ends coupled to the connector support ridge and inner ends coupled to the perimeter side wall of the flip-top cap, the retention fingers being coupled to the top rim of the curved band, and a hinge coupled to the body and to the flip-top cap to support the flip-top cap for movement relative to the body from a closed position covering a product-dispensing spout formed in the top wall and positioning the bottom rim of the curved band in closely confronting relation to the landing included in the body to an opened position away from the body uncovering the product-dispensing spout formed in the top wall, the retention fingers being arranged to extend into the finger-receiving channel formed in the body to limit movement of the flip-top cap relative to the body from the closed position toward the opened position until the tear strip is separated from the body to leave the temporary anchored position in response to fracture of the frangible connectors.

26. A tamper-evident closure comprising a body formed to include a product-dispensing spout and adapted to mount on a container filler neck, the body being formed to include a finger-receiving channel, a lid unit including a flip-top cap, a tear strip extending around a perimeter side wall of the flip-top cap, and frangible connectors coupled to the flip-top cap and to the tear strip in close proximity to a top rim thereof to retain the tear strip in a temporary anchored position on the flip-top cap, and a hinge coupled to the body and to the flip-top cap to support the flip-top cap for movement relative to the body from a closed position on the body covering the product-dispensing spout to an opened position away from the body uncovering the product-dispensing spout, the tear strip including retention means coupled to a bottom rim of the tear strip for extending into the finger-receiving channel formed in the body to limit movement of the flip-top cap relative to the body in the closed position and for leaving the finger-receiving channel upon movement to the opened position whereby the tear strip is separated from the body and leaves the temporary anchored position in response to fracture of the frangible connectors.

* * * * *